United States Patent [19]

Krembel, Jr.

[11] Patent Number: 4,480,539

[45] Date of Patent: Nov. 6, 1984

[54] ROTARY WHEEL MARKING HEAD AND INDEXING STRUCTURE THEREFOR

[75] Inventor: Frank Krembel, Jr., St. Clair Shores, Mich.

[73] Assignee: Columbia Marking Tools, Inc., Detroit, Mich.

[21] Appl. No.: 470,634

[22] Filed: Feb. 28, 1983

[51] Int. Cl.[3] ..... B41J 1/44

[52] U.S. Cl. ..... 101/18; 101/110

[58] Field of Search ..... 101/18, 110, 29, 85, 101/86, 45, 95, 96, 78, 79, 80

[56] References Cited

U.S. PATENT DOCUMENTS

| | | | |
|---|---|---|---|
| 3,429,258 | 2/1969 | Baranoff et al. | 101/110 X |
| 3,636,871 | 1/1972 | Speicher | 101/110 X |
| 3,916,785 | 11/1975 | Burger et al. | 101/110 X |
| 3,946,665 | 3/1976 | Valentine et al. | 101/110 X |
| 4,314,505 | 2/1982 | Krembel, Jr. | 101/18 X |

FOREIGN PATENT DOCUMENTS

| | | | |
|---|---|---|---|
| 534340 | 1/1922 | France | 101/18 |

*Primary Examiner*—Clifford D. Crowder

*Attorney, Agent, or Firm*—Barnes, Kisselle, Raisch, Choate, Whittemore & Hulbert

[57] ABSTRACT

A head with rotatable marking wheels indexable to select any one of a plurality of die symbols for marking a workpiece with a selected series of symbols. Each marking wheel is indexed by an associated cogwheel and a drive pawl which also prevents the marking wheel from overshooting the desired position when indexed. A centering pawl and the cogwheel also cooperate to yieldably center a die symbol in its desired position when its marking wheel is indexed and if it is shifted from such position by engagement with a workpiece.

14 Claims, 5 Drawing Figures

ROTARY WHEEL MARKING HEAD AND INDEXING STRUCTURE THEREFOR

BACKGROUND OF THE INVENTION

This invention relates to marking heads and more particularly to marking heads having rotatable marking wheels.

Marking heads having one and preferably a plurality of rotatable marking wheels are frequently used in various industrial applications to stamp one or a series of numbers or other symbols on a workpiece or part. Typically, a marking head has several rotatably mounted wheels each having a series of numbers or other symbols circumferentially spaced about the periphery of the wheel. Each wheel can be incrementally rotated or indexed to position the desired symbol for use in marking a workpiece. Usually each wheel is indexed or advanced by a pawl which successively engages one of a series of circumferentially spaced teeth of a cogwheel connected to or integral with the marking wheel. The teeth correspond with the array of circumferentially spaced symbols.

When marking relatively hard workpieces such as those made of iron or steel a large force must be applied to the marking head to stamp the numbers or symbols in the workpiece. With such a force irregularities in the surface of the workpiece tend to shift or rotate the marking wheels from their desired preselected positions. This sometimes results in damaging or even breaking the pawl, teeth of the cogwheel or other parts of the marking head.

Sometimes the marking wheel is rotated by this force sufficiently from its desired position so that a subsequent actuation of the pawl does not advance the marking wheel to the proper position to select the desired symbol for the next marking operation. Furthermore, if the marking wheel is rapidly indexed it occasionally overshoots or rotates farther than is desired and hence does not correctly position the desired symbol for the next marking operation.

BRIEF SUMMARY OF THE INVENTION

In a marking head embodying this invention the construction, arrangement and cooperation of the actuator pawl and cogwheel enable very rapid indexing of the marking wheel, avoid damage and breakage of the pawl and cogwheel, and provide reliable selection of the desired symbol by indexing the marking wheel. Preferably, a detent also cooperates with the cogwheel to assure reliable and accurate selection of the desired symbol when rapidly indexing the marking wheel. Preferably, the pawl is driven by a fluid actuated drive unit which can be easily and rapidly changed. Preferably a fluid responsive sensing system indicates when all of the marking wheels have been rotated to their preselected starting positions.

In some applications, a computer system with suitable software controls the indexing of the marking wheels to select the desired symbols for each marking operation. When the marking head is interfaced with a computer control system, to assure proper selection of the desired symbols, it is preferable to move each marking wheel to a predetermined starting position before indexing the marking wheel to select the desired symbols for a marking operation.

Objects, features and advantages of this invention are to provide a marking head which can be interfaced with a computer control system, permits the drive unit to be quickly and easily changed in the field, permits rapid indexing of the marking wheels, avoids damage to the pawls and cogwheels, reliably, repeatedly and accurately selects the desired symbol of each marking wheel, provides an indication of when the marking wheels are in a predetermined position of rotation, is rugged, durable, reliable and of relatively simple design and inexpensive manufacture and assembly, and requires little maintenance and service when in use.

BRIEF DESCRIPTION OF THE DRAWINGS

These and other objects, features and advantages of this invention will be apparent from the following detailed description, appended claims and accompanying drawings in which:

DETAILED DESCRIPTION OF THE INVENTION

Figure 1:
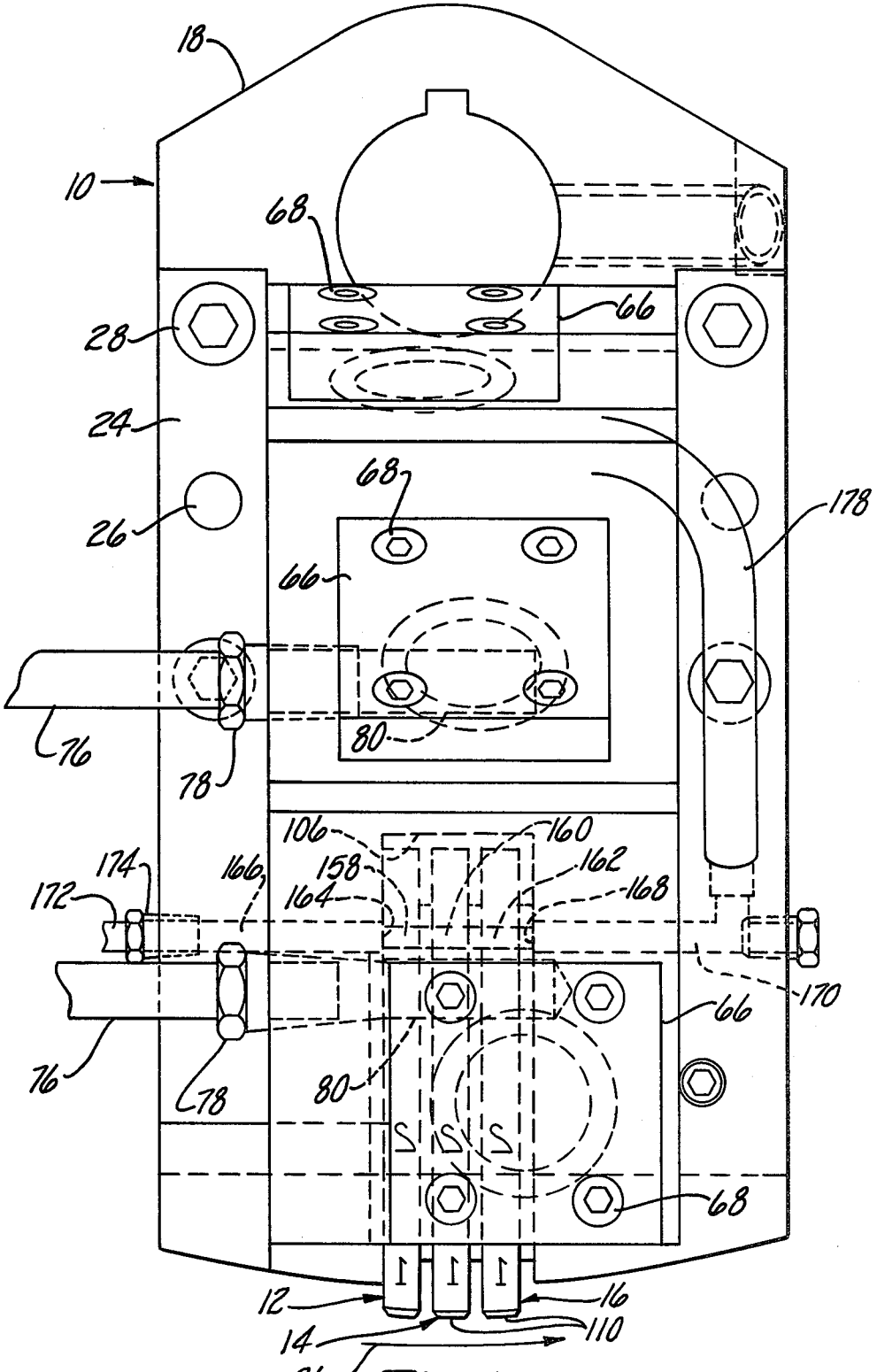
FIG. 1 is a front view of a marking head embodying this invention.
Figure 2:
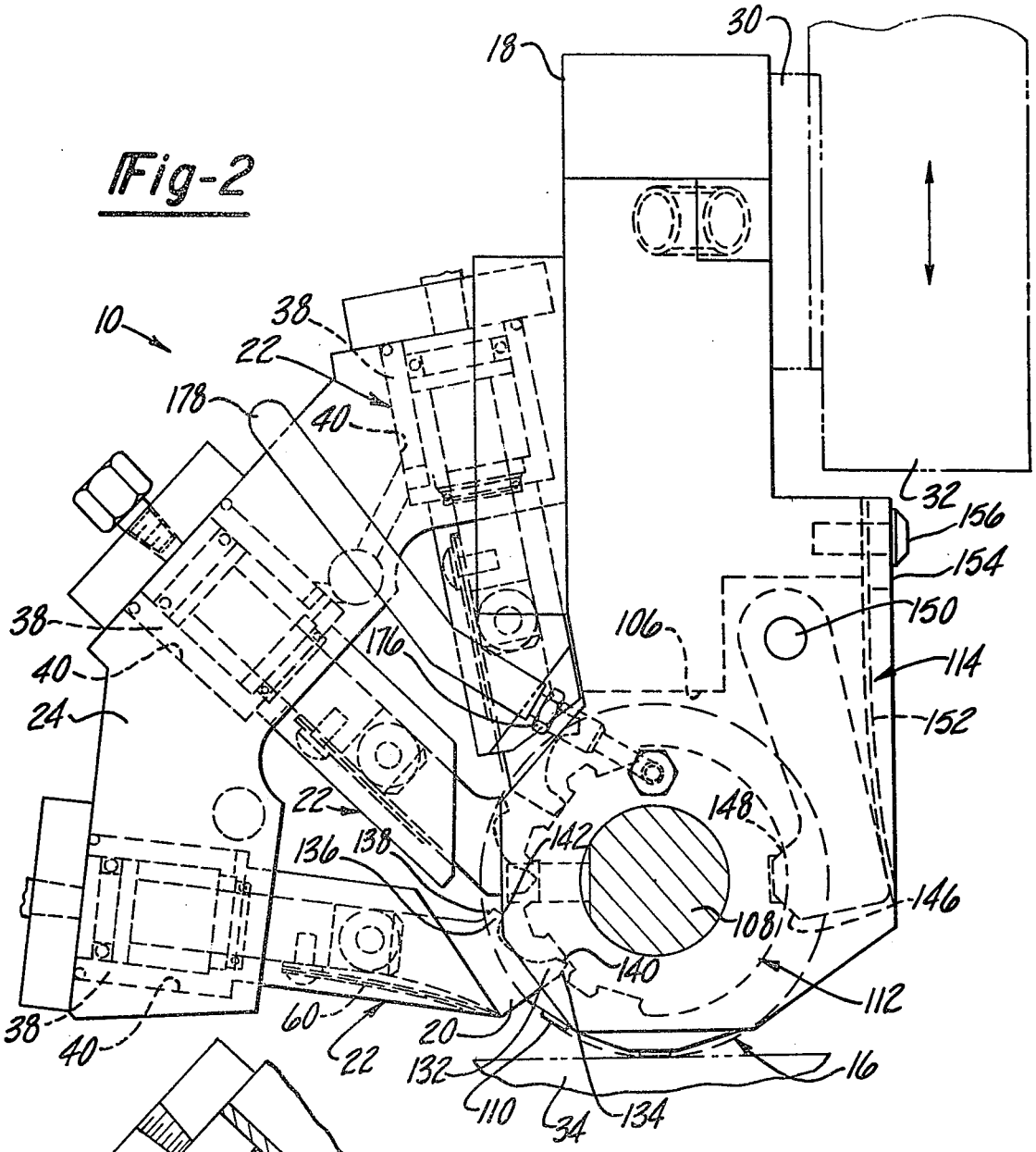
FIG. 2 is a side view of the marking head of FIG. 1 mounted on the arm of a marking press and forced into engagement with a workpiece.

Referring in more detail to the drawings, FIGS. 1 and 2 illustrate a marking head 10 embodying this invention having at least one and preferably a plurality of marking wheels 12, 14 and 16 carried by a frame 18. Each marking wheel is incrementally advanced and rotated by an associated pawl 20 actuated by a drive unit 22 carried by a support bracket 24 located on the frame 18 by pins 26 and secured to the frame by cap screws 28.

As shown in FIG. 2, in use marking head 10 is typically secured by a key to a shank 30 fixed to an arm 32 of a press (not shown) which forces the marking wheels into engagement with a workpiece 34 to mark the workpiece. To decrease the amount of force required to mark the workpiece, typically the arm 32 also rotates or rolls the marking head in an arc lying in a plane generally transverse to the axis of the shank as indicated by the arrow 36 in FIG. 1.

In accordance with one feature of this invention, each drive unit 22 is constructed and arranged so that it can be quickly and easily removed from the marking head and replaced. This facilitates service and maintenance of the marking head and minimizes downtime or the amount of time in which a marking head cannot be used because it needs to be serviced or repaired.

Figure 4:
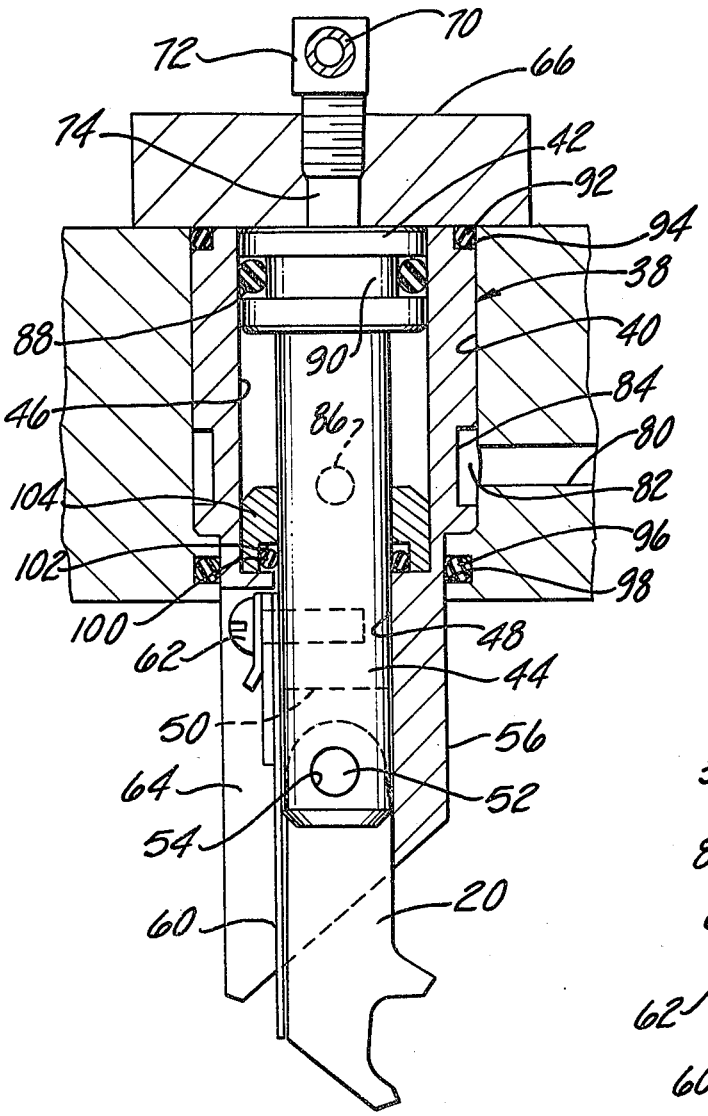
FIG. 4 is a fragmentary side view in section of a drive unit and pawl of the marking head of FIG. 1.
Figure 5:
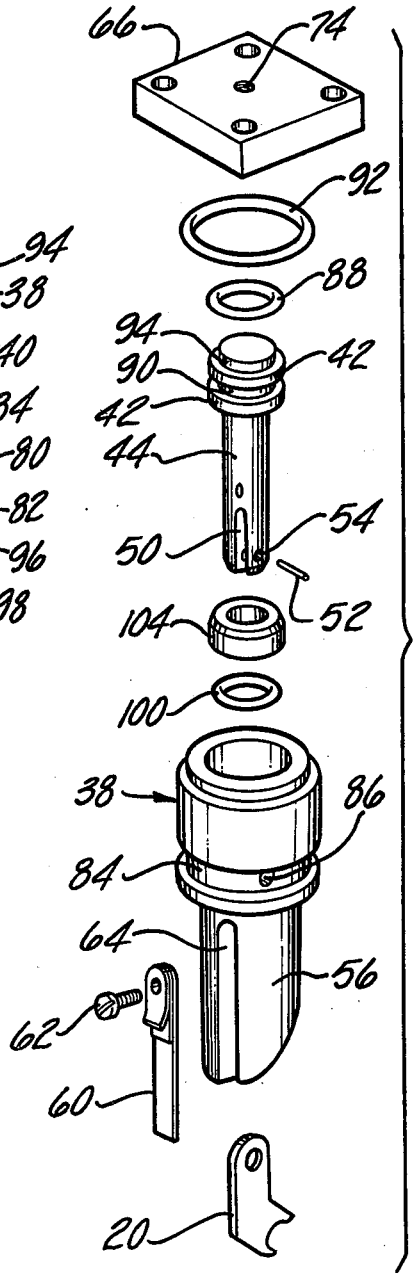
FIG. 5 is an exploded view of the component parts of the drive unit and pawl of FIG. 4.

As shown in FIGS. 2 and 4, each drive unit 22 has a sleeve 38 slidably received in a counterbore 40 in the mounting bracket 24. The pawl 20 is driven by a fluid actuated ram with a piston 42 and an actuator rod 44 slidably received in a counterbore 46 and a bore 48 in the sleeve 38. The pawl 20 is slidably received in a slot 50 in the end of the actuator rod 44 and pivotally mounted therein by a pin 52 received in a bore 54 through the rod. In assembly the pin 52 is entrapped in the actuator rod by a barrel 56 of the sleeve.

In assembly, the pawl 20 is yieldably biased toward its associated marking wheel by a leaf spring assembly 60 secured to the actuator rod by a screw 62. Clearance for the leaf spring assembly is provided by an elongate slot 64 in the sidewall of the barrel 56 of the sleeve. The slot 64 and the leaf spring assembly 60 and screw 62 also cooperate to provide a removable stop which prevents the piston 42 and rod 44 from falling out of the sleeve 38 and from rotating in the sleeve. The drive unit 22 is releasably retained in the counterbore 40 in the support bracket and the upper end of the sleeve is closed off by a head or cover plate 66 secured to the bracket by cap screws 68.

The piston 42 of each drive unit 22 is advanced by pressurized fluid admitted through a conduit 70 and an elbow 72 received in a threaded passage 74 through the cover plate 66. Each piston 42 is retracted by pressurized fluid admitted via a conduit 76, a fitting 78 threaded into a passage 80 in the mounting bracket, a circumferential passage 82 defined by the bore 40 and a circumferentially continuous groove 84 in the sleeve 38, and a port 86 through the sleeve. Fluid is prevented from leaking around the sleeve 38, the piston 42, and the actuator rod 44 by seals in the form of an O-ring 88 received in a groove 90 in the piston, an O-ring 92 received on a shoulder 94 in the sleeve, an O-ring 96 received in a groove 98 in the mounting bracket, and an O-ring 100 received in a counterbore 102 in a collar 104 which provides a stop for the piston.

As shown in FIGS. 1 and 2, the marking wheels 12, 14, and 16 are received in a slot 106 in the lower end of the frame 18, and are journaled to each rotate freely on a shaft 108 secured to the frame. Each marking wheel has an array of preferably equally circumferentially spaced numerals, letters and/or other marking die symbols 110. If each marking wheel has ten die symbols 110 such as the numerals "0" through "9" inclusive, when the wheels 12, 14, and 16 are appropriately indexed a succession of workpieces 34 can be serially numbered from "000" through "999".

Figure 3:
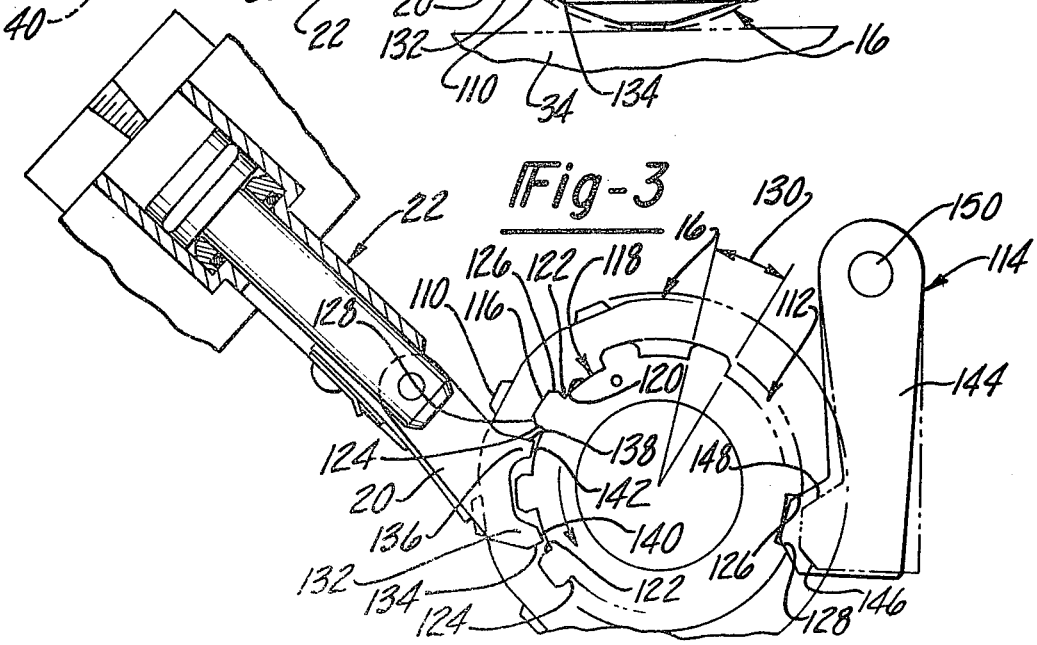
FIG. 3 is a semi-schematic side view of portions of the marking head of FIG. 1 showing the cooperation of a pawl, a cogwheel integral with the marking wheel and a detent.

In accordance with another feature of this invention each marking wheel can be indexed rapidly, reliably, accurately, and repeatedly even though limited rotary movement of the wheel from a selected position occurs during a marking operation to avoid damage to the marking head. This is due to the construction, arrangement, and cooperation of the pawl 20 and a cogwheel operably associated with each marking wheel. As shown in FIGS. 2 and 3 each marking wheel 12, 14 and 16 has on one side face a preferably internal cogwheel 112 with a series of circumferentially and preferably equally spaced teeth 116 about the periphery. Preferably each tooth 116 is generally radially aligned with an associated die symbol 110 on the marking wheel. Circumferentially spaced recesses 118 with a bottom face 120 are disposed between the teeth.

To facilitate and control the indexing of its associated marking wheel each tooth 116 has a pair of shoulders or abutment faces 122 and 124 and cam faces 126 and 128. Preferably, each abutment face 122 and 124 extends generally radially and lies in a plane containing the axis of rotation of its cogwheel 112. The circumferential width or angular extent of each tooth 116 is a function of the number and width of all the teeth 116 and the recesses 118. Preferably, the circumferential or angular width of each tooth is less than 360° divided by twice the number of teeth on their associated cogwheel. For example, if each marking wheel 12, 14 and 16 has ten die symbols 110 its associated cogwheel will have ten teeth 116 and the angular extent of each tooth should be less than about 18°, desirably in the range of about 12° to 16° and preferably about 14°.

To index or advance a marking wheel, it is rotated (counterclockwise as shown in FIGS. 2 and 3) by movement of its associated pawl 20 so that its leading finger 132 extends into a recess 118 and engages its blunt complimentary abutment surface 134 with a complimentary abutment 122 of a tooth 116 of the associated cogwheel. To prevent the marking wheel from being advanced too far or "overshooting" the desired index position (such as by the inertia of the wheel produced by it being rapidly indexed), a second finger 136 of the pawl 20 extends into an adjacent recess 118 and positions an abutment 138 for engagement with a complimentary shoulder 124 of another tooth 116 to stop or limit the advancement of the marking wheel. Preferably fingers 132 and 136 of the pawl also have end faces 140 and 142 which during at least a portion of the movement of the pawl bear on the bottom 120 of adjacent recesses 118 to pivotly move the pawl 20 with respect to the actuator rod 34.

As each marking wheel is indexed one of its die symbols 110 is yieldably centered or aligned for engagement with a workpiece (as shown in FIG. 2) by the cooperation of its associated cogwheel and a detent assembly 114. The detent assembly has a centering pawl 144 associated with each cogwheel. Each centering pawl has a forward and backward cam face 146 and 148 which are complimentary with cam faces 128 and 126 of an adjacent pair of teeth 116. Each centering pawl 144 is mounted on frame 118 for pivotal movement by a shaft 150 secured to the frame. Each centering pawl 144 is yieldably urged into engagement with its associated cogwheel 112 by a leaf spring 152 secured adjacent one end to the frame by a mounting plate 154 and a cap screw 156 with its other end bearing on the pawl. Preferably the complimentary cam faces 146, 148, 128 and 126 on the centering pawl and the teeth are constructed and arranged with sufficient length so that the marking wheel will be recentered when it is rotated from its centered position by up to substantially half of the circumferential or angular distance between adjacent marking symbols 110 on the wheel and then released.

To assure that the desired symbol 110 is selected by indexing a marking wheel a predetermined number of times it is necessary to be certain that the marking wheel is in a predetermined position before it is indexed the predetermined number of times. In accordance with another feature of this invention, a position sensor indicating that all of the marking wheels 12, 14 and 16 are in their respective predetermined positions is provided by a fluid under pressure which flows through passages 158, 160 and 162 of the marking wheels only when the passages simultaneously register with each other, an outlet 164 of an inlet passage 166 in the frame 18, and an inlet 168 of an outlet passage 170 in the frame. The outlet 164, inlet 168, and all three passages 158, 160 and 162 in the marking wheel are in simultaneous registry or generally axially alignment only when all three of the marking wheels are in their predetermined positions.

Fluid under pressure is supplied to the inlet passage 166 through a conduit 172 and a fitting 174 threaded into the passage. Fluid under pressure passes from the outlet passage 170 through a fitting 176 threaded into the passage and a conduit 178. The increase in the fluid pressure in the outlet passage 170, which occurs when all the marking wheels are in their predetermined starting positions, is preferably converted into an electric signal by a pressure responsive electric switch coupled to the conduit 178 and appropriate electric circuitry (not shown). A suitable electric switch is a series AP pressure responsive switch sold by the Mercoid Corporation, 4201 Belmont Ave., Chicago, Ill. 60641. With a series AP Mercoid pressure switch the position sensor will operate properly when a fluid such as air is supplied to the inlet passage 166 at a relatively low pressure in the range of about 2–5 psig.

Each drive unit 22 can be actuated and controlled by a conventional electro-pneumatic circuit with a four way two position valve (not shown). Suitable four way valves for rapidly actuating the drive units are MARK 1 double solenoid actuated valves sold by Numatics, Inc. of Highland, MI 48031. With these MARK 1 four way valves, a marking wheel may be indexed or advanced by one die symbol 110 in less than 1/10th of a second, and if the wheel has ten die symbols it can be indexed through one complete revolution in about one second. This extremely rapid indexing facilitates use of a computer system to control indexing of the marking wheels to properly position the desired die symbol of each wheel for each marking operation.

In use, the marking head 10 is typically mounted on the actuating arm 32 of a marking press or machine and the drive units 22 and marking wheel position sensor are connected to suitable sources of a fluid under pressure such as compressed air and suitable electro-pneumatic control circuits. Initially, the arm 32 of the marking machine is retracted so that the marking head 10 is disengaged and spaced from the workpiece 34 and all the marking wheels are in their predetermined starting positions.

With each marking wheel in its predetermined starting position, the outlet 164, inlet 168, and all the passages 158, 160 and 162 of the marking wheels are in registry or generally axially aligned so that fluid under pressure flows from the supply passage 166 into the discharge passage 170 and trips or changes the state of the electric contacts of the pressure responsive switch to thereby provide an indication that all of the marking wheels are in their predetermined starting positions. Through appropriate electric circuitry the position sensor renders inoperative the control system for indexing the marking wheels to set up a predetermined series or sequence of die symbols 110 for marking a workpiece until the position sensor produces a signal indicating the marking wheels are all in their predetermined starting positions. If the marking head is used to mark workpieces with a series of numbers such as "000" through "999" the starting position for each marking wheel is typically that which orients the wheels so that they would mark "000" on a workpiece.

Preferably, the control system such as a computer control system selects the numerals or symbols to be marked on a workpiece, determines the number of times each marking wheel should be indexed from its starting position to properly orient the selected numerals or die symbols on the wheels for marking the workpiece, and initiates and controls the indexing of each wheel from its starting position the predetermined number of times required to properly orient the selected numerals or die symbols for marking the workpiece. For example, if the numerals or symbols selected to be marked on the workpiece are "234" the computer control system will initiate and control operation of the drive units 22 to index the marking wheels 12, 14 and 16, two, three and four times respectively from their respective starting positions.

To complete one index of a marking wheel, the piston 42 and actuator rod 44 of its associated drive unit 22 are fully extended and then fully retracted by energizing the solenoids of its associated four way control valve and electro pneumatic circuit. As actuator rod 44 is extended, its associated pawl 20 is advanced and pivots so that the abutment 134 of its first finger 132 bears on an abutment 122 of one of the teeth 116 of the cogwheel 112 associated with the marking wheel to advance or rotate them counterclockwise in unison one increment or index as shown in FIGS. 2 and 3.

As the marking wheel is advanced, its associated centering pawl 144 is cammed out of and disengages from one recess 118 of the cogwheel and moves into an immediately adjacent recess and engages its cam faces 146 and 148 with the cam faces 128 and 126 of the adjacent recess to center the marking wheel in its indexed or advanced position. Centering pawl 144 also retards the tendency of the marking wheel to overshoot its centered position as it is advanced by the drive pawl 20. Moreover, when the drive pawl 20 is advanced it prevents the marking wheel from overshooting its advanced position to such an extent that it cannot be centered by the centering pawl 144 by positioning the abutment 138 on the second finger 136 of the drive pawl so that it can be engaged by an abutment 124 on a tooth 116 of the cogwheel 112 associated with the marking wheel. After the marking wheel has been advanced, the piston 42, rod 44 and pawl 20 of the drive unit are retracted to thereby complete one index of the marking wheel. To minimize the total time required to set all of the marking wheels for marking a workpiece, the marking wheels may all be indexed at the same time.

After all of the marking wheels have been indexed a predetermined number of times to properly position the selected numbers or die symbols 110, the arm 32 of the marking machine is advanced to mark the workpiece. In heavy duty marking machines the arm 32 is also rotated or moves in an arcuate path to decrease the maximum force required to press the selected numbers or die symbols 110 into the workpiece 34 and thereby mark or stamp the workpiece. When marking most workpieces, forces are created which tend to rotate the marking wheels slightly in one direction or the other from their centered positions. Since the drive pawls 20 are disengaged from the teeth 116 of the cogwheels, and the rotation of the cogwheels and hence the marking wheels is only yieldably restrained by the centering pawls 144, the component parts of the marking head are not damaged even though the forces causing this rotary movement are of sufficient magnitude that the drive pawls and other components would be damaged if they restrained this movement.

After the workpiece 34 has been marked, the arm 32 of the marking machine is retracted to disengage the marking head 10 from the workpiece. If when forced into the workpiece the marking wheels were shifted from their centered positions, when they disengage from the workpiece, they are recentered by their associated centering pawls 144. Each centering pawl is urged by its associated leaf spring 152 into a recess 118 of the cogwheel 112 associated with the marking wheel so that its cam faces 146 and 148 engage cam faces 128 and 126 adjacent the recess to recenter the marking wheel. This recentering assures that the previously selected die symbol is still in its marking position so that when the marking wheel is next indexed, as discussed below, it will be reset to its starting position.

After the marking head 10 is disengaged from the workpiece and the marking wheels are recentered, each marking wheel is indexed or advanced (counterclockwise as shown in FIG. 3) to return or reset all of the marking wheels to their predetermined starting positions. The number of times each marking wheel must be indexed to be returned to its starting position is determined by the computer or other control system. For example, if the marking wheels were set to mark the workpiece with the numeral "234" and each wheel has a total of ten die symbols (the numerals "0" through "9") the wheels 12, 14 and 16 would be respectively indexed eight, seven, and six times to advance all of the wheels to their reset or starting positions of "000". To minimize the total time required to reset all the marking wheels, they may all be indexed at the same time.

When all the wheels are reset to their starting positions of "000", the fluid under pressure, such as air, passes through supply passage 166, passages 158, 160 and 162 in the wheels, discharge passage 170 and conduit 176 to actuate the pressure responsive switch and thereby provide a signal indicating all of the marking wheels have been correctly reset to their starting positions. This reset signal can be used to activate the computer or other control system to initiate orienting the marking wheels for another marking cycle for another workpiece.

I claim:

1. In a marking head having a frame, at least one marking wheel carried by said frame and rotatable relative to said frame to align successive circumferentially arrayed marking symbols thereon for marking a workpiece, and a cogwheel operably connected with said marking wheel for rotation in unison therewith and having successive circumferentially arrayed teeth with radially inward recesses therebetween with at least one tooth for each said marking symbol, the improvement comprising a reciprocal drive member carried by said frame, a drive pawl actuated by said drive member and having first and second fingers constructed, arranged and circumferentially spaced apart such that when said drive pawl is moved to an extended position by said drive member said fingers each project into one of an adjacent pair of said recesses in said cogwheel, a first face on said first finger constructed and arranged to engage a complimentary face on a tooth of said cogwheel to rotatably index said cogwheel and associated marking wheel as said drive pawl is moved to said extended position such that said marking wheel is rotated in one direction to advance a marking symbol more than one half the angular extent between an adjacent pair of said marking symbols, and a second face on said second finger constructed and arranged so that when said drive pawl is in said extended position and said cogwheel has been rotated to advance a marking symbol generally into alignment for marking a workpiece said second face can engage a complimentary face on a tooth to limit further rotation in said one direction of said marking wheel to less than about one half of the angular extent between an adjacent pair of said marking symbols, whereby movement of said pawl from its retracted to its extended position advances a marking symbol generally into alignment for marking a workpiece and while said drive pawl is in said extended position such advancing of said marking symbol beyond such alignment for marking a workpiece is limited to not more than about one half the angular extent between adjacent marking symbols.

2. The marking head of claim 1 which also comprises a cylinder carried by said frame, and a piston slidably received in said cylinder and connected to said drive member whereby said drive member is actuated by admission of a fluid under pressure into said cylinder.

3. The marking head of claim 2 which also comprises a mounting member carried by said frame and having a bore and a counterbore, a sleeve slidably received in said counterbore and having a bore therein defining at least in part said cylinder, a cover overlying said counterbore, being releasably securable to said mounting member, and constructed, arranged and dimensioned with respect to said counterbore and said sleeve such that when secured to said mounting member said sleeve is entrapped in said mounting member.

4. The marking head of claim 1 which also comprises a mounting member carried by said frame and having a bore and a counterbore, a sleeve slidably received in said counterbore and having a bore and a counterbore therein with said latter counterbore defining at least in part a cylinder, a piston slidably received in said cylinder and connected to said drive member with said drive member being slidably received in said bore in said sleeve, a slot in said sleeve which opens into said bore in said sleeve, a stop member disposed in said slot and releasably connected to said drive member such that said stop member limits rotation of said drive member with respect to said sleeve and prevents removal of said drive member from said sleeve.

5. The marking head of claim 4 which also comprises a pin pivotally connecting said drive pawl to said drive member, said pin being removably carried by said drive member, and said sleeve being constructed and arranged such that said pin is entrapped in said drive member by said sleeve throughout the full extent of the travel of said drive member in said sleeve.

6. The marking head of claim 4 which also comprises a leaf spring at least in part received in said slot in said sleeve, bearing on said drive pawl, and being removably secured to said drive member.

7. The marking head of claim 1 which also comprises a fluid passage through each marking wheel spaced radially outwardly of the axis of rotation of the marking wheel and having an inlet in one side face and an outlet in the other side face of the marking wheel, a fluid outlet port carried by said frame and constructed and arranged to register with the inlet of the passage of an immediately adjacent marking wheel when said marking wheel is in a predetermined position of angular rotation, a fluid inlet port carried by said frame in spaced relation to said outlet port carried by said frame and immediately adjacent a marking wheel and constructed and arranged such that the outlet of the fluid passage through said marking wheel registers with said inlet port carried by said frame only when said marking wheel is in a predetermined position of angular rotation, and all of said ports and passages are constructed and arranged such that a fluid can flow from said outlet port carried by said frame through all of the passages of all of said marking wheels and into said inlet port carried by said frame only when all of said marking wheels are simultaneously in their respective predetermined positions of rotation, thereby providing an indication that each of said marking wheels is in its respective predetermined position of rotation.

8. The marking head of claim 7 which also comprises a switch having a pair of electric contacts constructed and arranged to change state in response to a change in pressure of fluid in said inlet port carried by said frame, whereby the contacts of said switch change state in response to fluid pressure to thereby indicate that all of said marking wheels are in their respective predetermined positions of rotation.

9. The marking head of claim 8 wherein said switch is constructed and arranged to change state in response to a change in fluid pressure of less than 5 lbs. per square inch.

10. The marking head of claim 1 which also comprises a centering pawl carried by said frame, means yieldably urging said centering pawl into engagement with said cogwheel, and a pair of spaced apart third faces on said centering pawl constructed and arranged to each engage a complimentary face on one of a pair of adjacent teeth of said cogwheel when one of said marking symbols on its associated marking wheel is in alignment for marking a workpiece, and to urge said marking wheel into said alignment when said marking wheel is rotated in either direction from said alignment less than about one half of the angular distance between adjacent marking symbols on said marking wheel.

11. The marking wheel of claim 10 which also comprises said first finger of said drive pawl being constructed and arranged to project into a recess in said cogwheel when said drive pawl is retracted and at least yieldably restrain the extent of rotation of said marking wheel in either direction from said alignment of a marking symbol to not more than about one half the angular distance between adjacent marking symbols on said marking wheel.

12. The marking head of claim 11 wherein when said drive pawl is retracted said first finger of said drive pawl is constructed and arranged to positively limit rotation of said marking wheel in one direction from said alignment of a marking symbol to not more than about one half the angular distance between adjacent marking symbols of said marking wheel.

13. The marking wheel of claim 1 which also comprises said first finger of said drive pawl being constructed and arranged to project into a recess in said cogwheel when said drive pawl is retracted and at least yieldably restrain the extent of rotation of said marking wheel in either direction from said alignment of a marking symbol to not more than about one half the angular distance between adjacent marking symbols on said marking wheel.

14. The marking head of claim 13 wherein when said drive pawl is retracted said first finger of said drive pawl is constructed and arranged to positively limit rotation of said marking wheel in one direction from said alignment of a marking symbol to not more than about one half the angular distance between adjacent marking symbols of said marking wheel.

* * * * *